US010663249B1

(12) United States Patent
Liu

(10) Patent No.: US 10,663,249 B1
(45) Date of Patent: May 26, 2020

(54) CROSSBOW WITH QUICK-SHOOTING DEVICE

(71) Applicant: Chi-Chang Liu, Taichung (TW)

(72) Inventor: Chi-Chang Liu, Taichung (TW)

( * ) Notice: Subject to any disclaimer, the term of this patent is extended or adjusted under 35 U.S.C. 154(b) by 0 days.

(21) Appl. No.: 16/248,701

(22) Filed: Jan. 15, 2019

(51) Int. Cl.
*F41B 5/12* (2006.01)

(52) U.S. Cl.
CPC ..... *F41B 5/126* (2013.01)

(58) Field of Classification Search
CPC ..... F41B 5/12; F41B 5/126; F41B 5/1469
USPC ..... 124/25, 25.5, 45, 49, 51.1, 86
See application file for complete search history.

(56) References Cited

U.S. PATENT DOCUMENTS 28,698 A * 6/1860 Stevens ..... F41B 5/126 124/25
320,643 A * 6/1885 Engle ..... F41B 5/126 124/26
1,985,079 A * 12/1934 Conklin ..... F41A 9/24 124/25
2,214,224 A * 9/1940 Douglas ..... F41B 11/51 124/67
2,516,341 A * 7/1950 Raffeis ..... F41B 5/126 124/49
2,554,966 A * 5/1951 Stevens ..... F41B 5/12 124/25
2,918,050 A * 12/1959 Kopman ..... F41B 5/12 124/25
3,572,311 A * 3/1971 Baer ..... F41B 3/02 124/20.1
3,739,765 A * 6/1973 Moore ..... F41B 5/12 124/25
3,968,783 A * 7/1976 Pfotenhauer ..... F41B 5/126 124/25
5,062,406 A * 11/1991 Robertson ..... F41B 5/12 124/22
5,437,260 A * 8/1995 King ..... F41B 5/12 124/25
5,544,641 A * 8/1996 Jenn ..... F41B 5/12 124/25
5,678,528 A * 10/1997 Hadley ..... F41B 5/12 124/24.1
5,711,284 A * 1/1998 Keenan, Jr. ..... F41B 5/14 124/49
6,705,304 B1 * 3/2004 Pauluhn ..... F41B 5/12 124/25
6,868,845 B1 * 3/2005 Moore ..... F41B 5/126 124/25
7,753,041 B2 * 7/2010 Ogawa ..... F41B 5/12 124/25
7,784,453 B1 * 8/2010 Yehle ..... F41B 5/12 124/25

(Continued)

*Primary Examiner* — Alexander R Niconovich

(57) ABSTRACT

A crossbow includes a barrel, a cocking device, a bow device, a link device and a cartridge. The retention member is moved by the operation of the string of the bow device. The cocking device detachably holds the string. By repeatedly operating the link device and pulling the trigger, the cocking device is moved back and forth repeatedly, and the retention member moves back and forth to control the restriction member to pivot so that the bullets continuously drop to the groove and located in front of the retention member. Therefore, the crossbow can shoot the bullets continuously. The bullets are allowed to be fed into the cartridge one time of feeding.

9 Claims, 14 Drawing Sheets

(56) References Cited

U.S. PATENT DOCUMENTS

| | | | | |
|---|---|---|---|---|
| 7,810,480 | B2 * | 10/2010 | Shepley | F41A 11/02 124/25 |
| 7,997,258 | B2 * | 8/2011 | Shepley | F41B 5/1469 124/25 |
| 8,087,405 | B2 * | 1/2012 | Mitchell | F41B 11/646 124/56 |
| 8,991,374 | B1 * | 3/2015 | Conkel | F41B 5/126 124/23.1 |
| 9,261,322 | B1 * | 2/2016 | Conkel | F41B 5/126 |
| 9,395,142 | B2 * | 7/2016 | Rodich | F41B 5/126 |
| 9,513,075 | B2 * | 12/2016 | Lallier | F41A 9/73 |
| 10,378,853 | B1 * | 8/2019 | Liu | F41B 5/12 |
| 10,408,561 | B1 * | 9/2019 | Liu | F41B 5/12 |
| 10,495,403 | B1 * | 12/2019 | Liu | F41B 5/143 |
| 2019/0331453 | A1 * | 10/2019 | Zou | F41B 5/126 |

* cited by examiner

CROSSBOW WITH QUICK-SHOOTING DEVICE

BACKGROUND OF THE INVENTION

1. Fields of the Invention

The present invention relates to a crossbow, and more particularly, to a crossbow with a quick-shooting device that allows the crossbow to shoot bullets continuously.

2. Descriptions of Related Art

The conventional crossbows uses a bow connected to a barrel and has a cocking device to efficiently pull the string to shoot the arrows by the energy stored by the strings. However, the arrows have to be set to the crossbow one by one, and this takes time. In other words, the crossbows cannot shoot arrows continuously, and this shortcoming restricts the use of the crossbows.

Some developers develop a crossbow that shoots bullets which are in a form of balls or beads. The main concern for this improved crossbow is how to quickly feed the bullets and shoot the bullets continuously. The balls or beads are small and have a smooth outer surface so that when feeing the bullets, the balls or beads easily drop to affect the shooting processes.

The present invention intends to provide a quick-shooting device that is cooperated with a crossbow to improve the shortcomings mentioned above.

SUMMARY OF THE INVENTION

The present invention relates to a crossbow and comprises a barrel having a front end and a rear end. A track is defined in the top of the barrel and opens through the front end of the barrel. A handle is connected to underside of the rear end of the barrel. A cocking device is connected to the barrel and located above the handle. The cocking device includes a slide installed to the track and has a groove. A is connected to the barrel. A retention member is slidably engaged with the groove and includes an engaging portion. The string connected between two ends of the bow extends through the retention member. When the engaging portion moves away from the bow, the engaging portion is engaged with the cocking device to pull the string. A cartridge is connected to the top of the barrel and fixed to the slide. The cartridge includes a storage space which includes an entrance and an outlet respectively defined in two ends thereof. A restriction member is located in the storage space and located close to the outlet. The restriction member includes a contact end, a push end and a recess. The recess is located between the contact end and the push end. When the cocking device moves toward the rear end of the barrel, the cocking device pushes the push end of the restriction member and the restriction member is pivoted. The contact end contacts a bullet in the storage space. The recess communicates with the outlet, and the bullet drops to the groove and located in front of the retention member. When the cocking device is disengaged from the engaging portion, the retention member is pushed by a recovery force of the string and deliveries the bullet out.

The retention member is repeatedly moved to pivot the restriction member by operation of the string and the cocking device, and the bullets continuously drop into the groove of the slide and located in front of the retention member. Therefore, when the users pull the trigger repeatedly, the crossbow shoots continuously. Besides, multiple numbers of the bullets are fed into the cartridge within one time of feeding.

The primary object of the present invention is to provide a crossbow, wherein multiple bullets are received in the cartridge so as to save the users a lot of time to feed the bullets. The bullets are prevented from dropping as seen on the conventional crossbows if the users have to pick and feed the bullets one by one.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
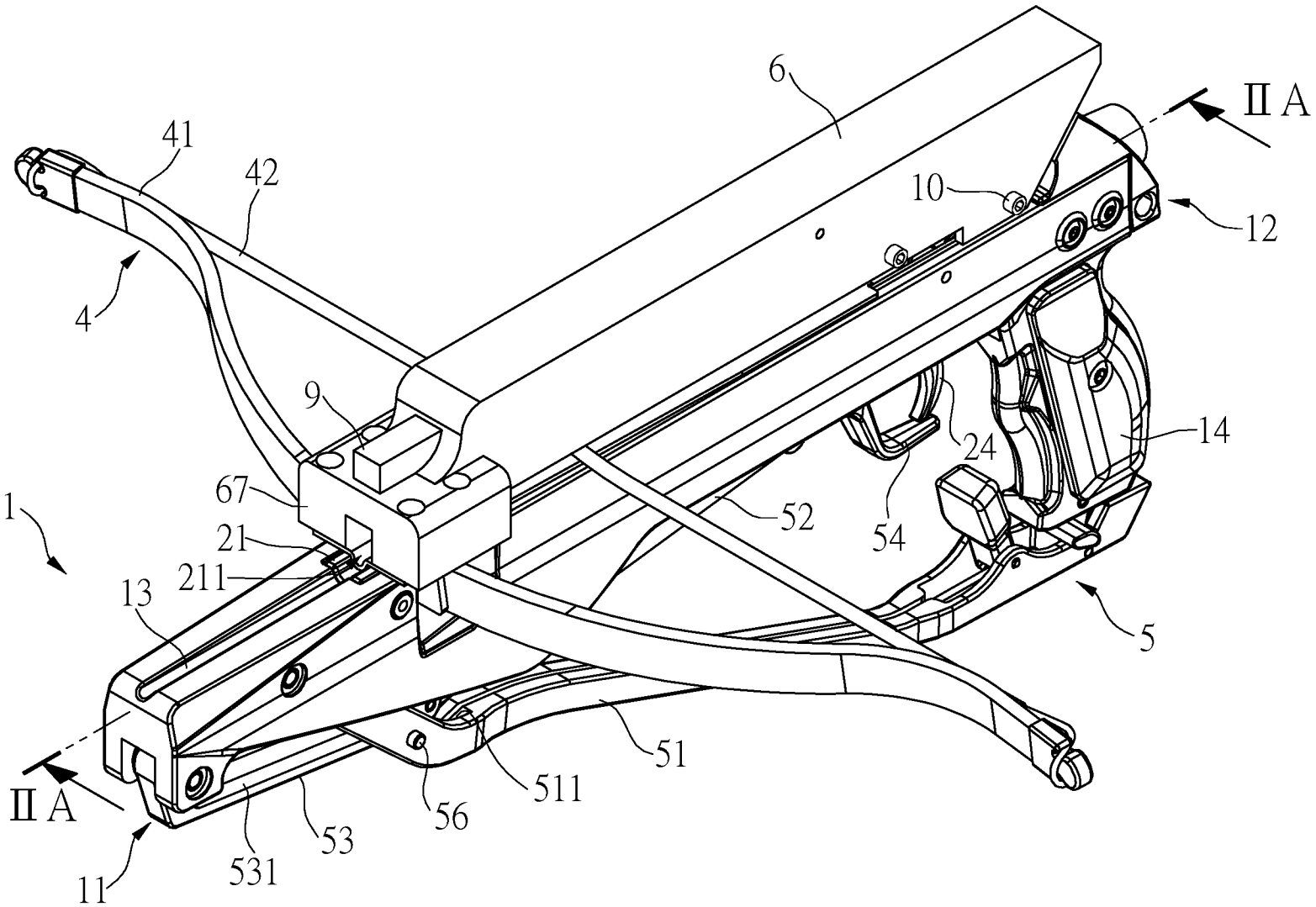
FIG. 1 is a perspective view to show the crossbow of the present invention.

Referring to FIGS. 1 to 12, the crossbow of the present invention comprises a barrel 1 which has a front end 11 and a rear end 12, and a track 13 is defined in the top of the barrel 1 and opens through the front end 11 of the barrel 1. A handle 14 is connected to the underside of the rear end 12 of the barrel 1. A cocking device 2 is connected to the barrel 1 and located above the handle 14. The cocking device 2 includes a slide 21, a frame 22, a positioning member 23 and a trigger 24. The slide 21 is installed to the track 13, and has a groove 211. The frame 22 has the first end thereof connected to the track 13 and is located close to the handle 14, and the second end of the frame 22 protrudes beyond the track 13. A room 212 is defined between frame 22 and the top of the barrel 1. The frame 22 is connected to the slide 21 and movable in the track 13 defined in the top of the barrel 1. The positioning member 23 has one end thereof inserted into the frame 22 and is pivotably connected with the inside of the frame 22.

The positioning member 23 is located in the room 212. A resilient member 3 is located between the frame 22 and the positioning member 23. One end of the resilient member 3 is mounted to the underside of the positioning member 23, and another end of the resilient member 3 is fixed to the inside of the frame 22. The resilient member 3 drives the positioning member 23 to pivot and to return. The trigger 24 has one end thereof inserted into the track 13 from the underside of the barrel 1 and pivotably connected to the frame 22. The end inserted into the track 13 of the trigger 24 contacts the positioning member 23. Another end of the trigger 24 extends beyond the barrel 1. The trigger 24 is pivoted and drives the positioning member 23 to pivot, and trigger 24 returns by the recovery force of the resilient member 3.

A bow device 4 is connected to the barrel 1 and includes a bow 41, a string 42 and a retention member 43. The bow 41 is transversely connected to the barrel 1, and the string 42 is connected between two ends of the bow 41. The retention member 43 is slidably engaged with the groove 211 and includes an engaging portion 431 that extends in the direction away from the bow 41. The string 42 extends through the retention member 43. When the engaging portion 431 moves away from the bow 4, the engaging portion 431 is engaged with the cocking device 2 to pull the string 42.

A link device 5 is connected to the underside of the barrel 1. The front end of the link device 5 is pivotably connected to the underside of the front end 11 of the barrel 1, and the rear end of the link device 5 is fixed to the slide 21 and removably engaged with the lower end of the handle 14.

A cartridge 6 is connected to the top of the barrel 1 and fixed to the slide 21. The cartridge 6 includes a storage space 61 which includes an entrance 62 and an outlet 63 respectively defined in two ends thereof. A restriction member 64 is located in the storage space 61 and located close to the outlet 63. The restriction member 64 includes a contact end 641, a push end 642 and a recess 643. The recess 643 is located between the contact end 641 and the push end 642. When the retention member 43 moves toward the rear end 12 of the barrel 1, the cocking device 2 pushes the push end 642 of the restriction member 64 and the restriction member 64 is pivoted. The contact end 641 contacts a bullet 7 in the storage space 61, because the recess 643 communicates with the outlet 63, so that the bullet 7 drops to the groove 211 and located in front of the retention member 43.

By repeatedly operating the link device 5 and pulling the trigger 24, the cocking device 2 is moved back and forth repeatedly between the front end 11 and the rear end 12, and the retention member 43 moves back and forth to control the restriction member 64 to pivot so that the bullets 7 continuously drop to the groove 211 and located in front of the retention member 43. When the cocking device 2 is disengaged from the engaging portion 431, the retention member 43 is pushed by a recovery force of the string 42 and deliveries the bullet 7 out. Therefore, the crossbow can shoot the bullets 7 continuously. Besides, the bullets 7 can be fed into the cartridge within one time of feeding.

The present invention provides a cartridge 6 which can be fed with multiple bullets 7 within one time of feeding, and the users do not take the risks of dropping the bullets when feeding the bullets 7 to the crossbows as seen on the conventional crossbows as mentioned above. The cartridge 6 is installed to the barrel 1, one end of the cartridge 6 is connected to the slide 21, and the other end of the cartridge 6 is connected to the frame 22. The bullets 7 are stopped by the contact end 641 of the restriction member 54 of the present invention. When the trigger 24 is pulled, the positioning member 23 is driven and releases from the retention member 43, so that the retention member 43 is pushed by the recovery force of the string 42 to shoot the bullet 7. After the first bullet is shot 7, the user pivots the link device 5 to control the cocking device 2 to move toward the retention member 43, and the let the positioning member 23 to be engaged with the engaging portion 431 of the retention member 43. Then the link device 5 is pivoted back, which then slides the cocking device 2 back, and the cocking device 2 and the retention member 43 are moved together. The retention member 43 pulls the string 42. During the movement of the retention member 43, the retention ember 43 pivots the restriction member 64 which allows the bullet 7 to drop from the outlet 643 to the groove 211, and located in front of the retention member 43. When engaging portion 431 of the retention member 43 is inserted into the room 212, the bullet 7 is ready to be shot. By repeatedly operating the above steps, the crossbow can shoot the bullets 7 continuously as shown in FIGS. 5 to 12.

Figure 8:
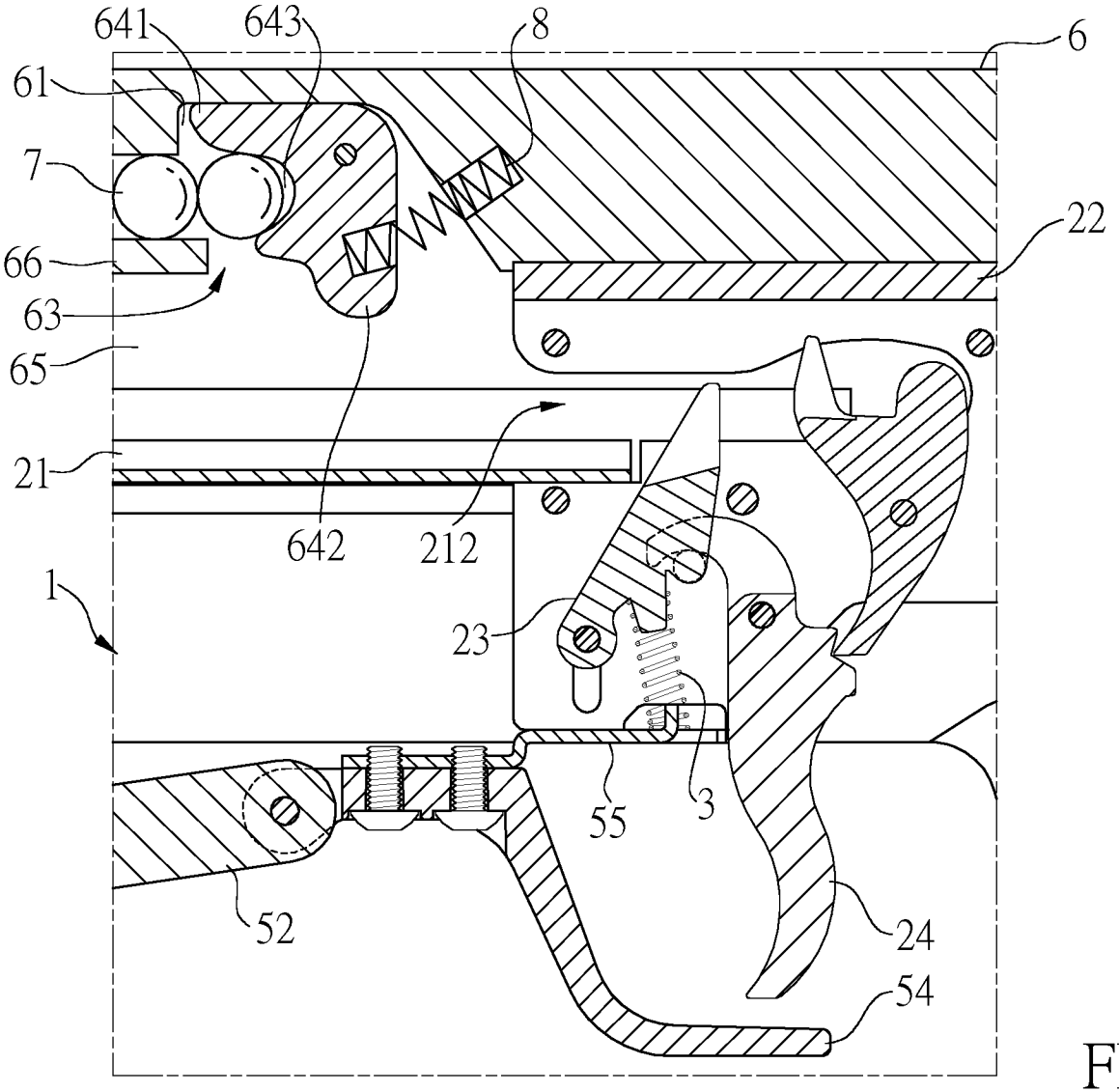
FIGS. 8 to 10 shows that the retention member pivots the restriction member to allow the bullets to drop from the outlet to the groove of the slide, and the bullets are located in front of the retention member.
Figure 9:
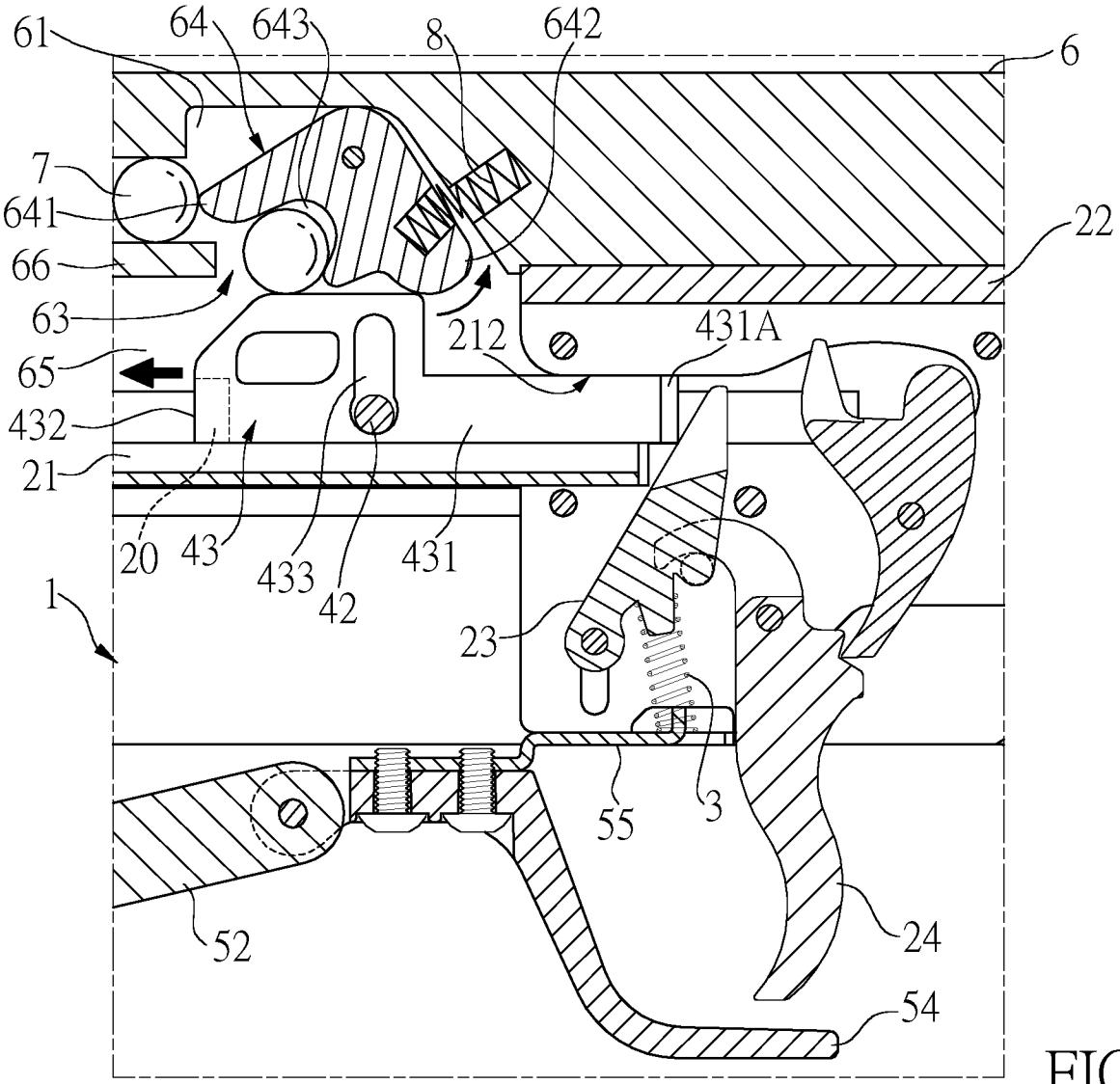
Figure 10:
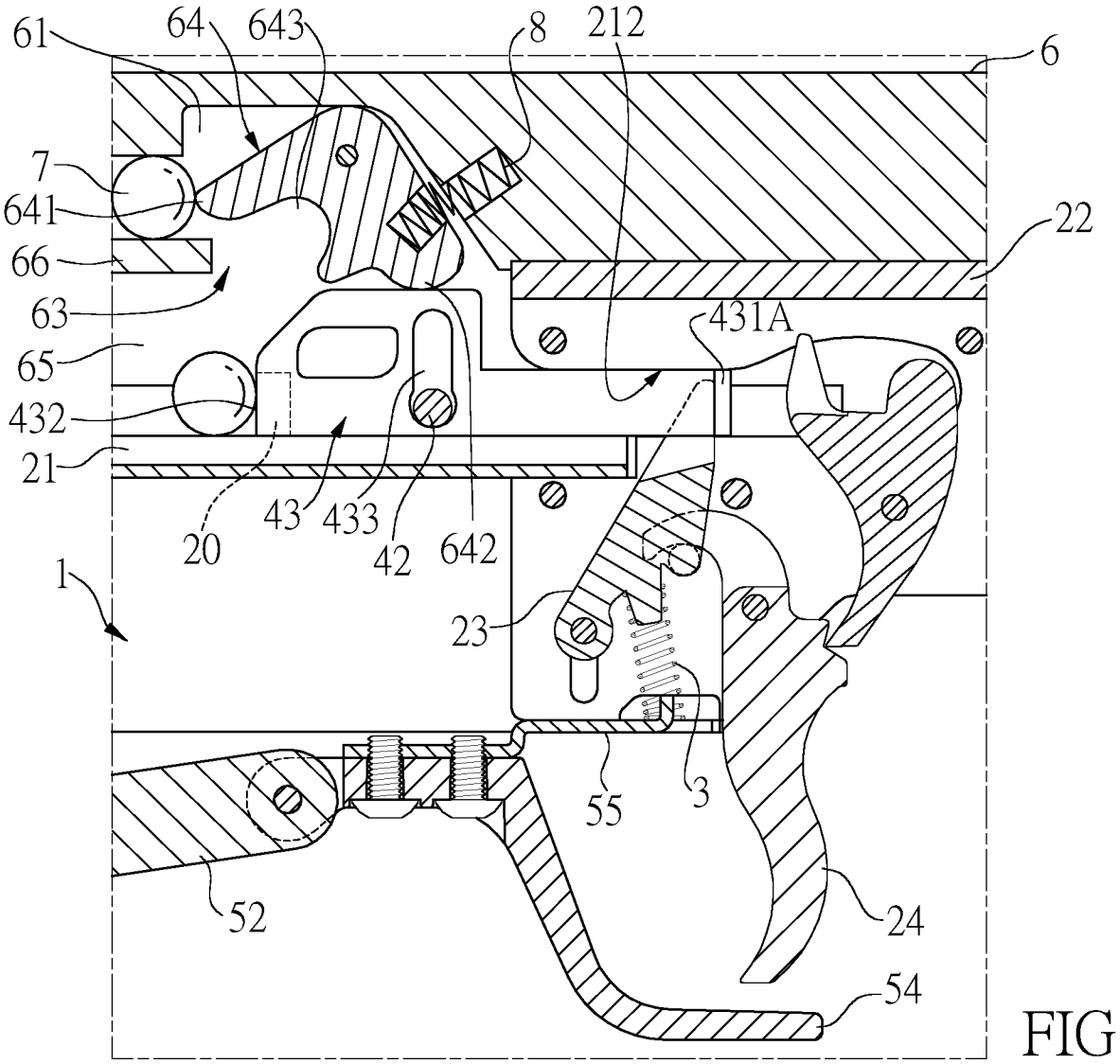
Figure 11:
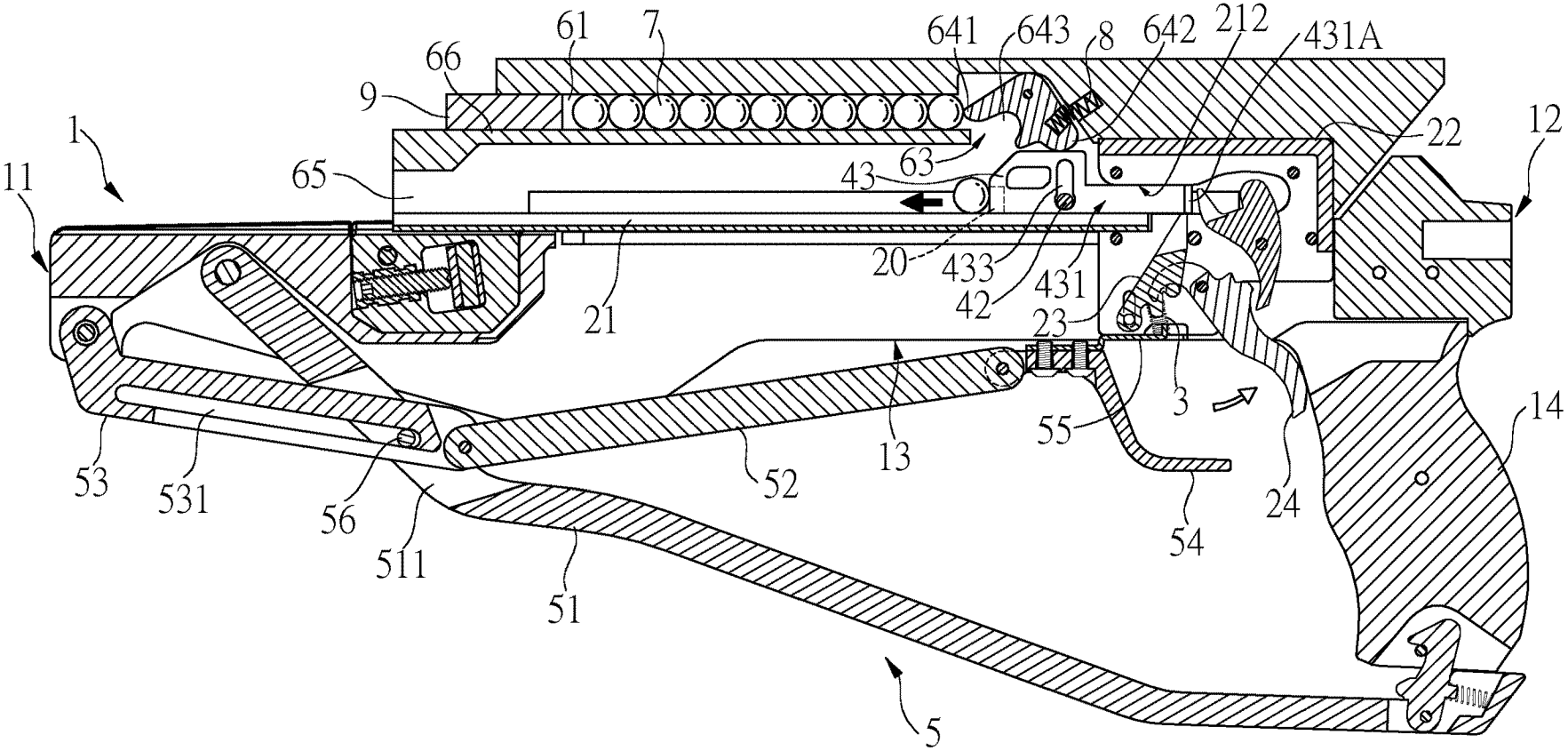
FIG. 11 shows that the trigger is pivoted, the positioning member is pivoted to release the contact between the positioning member and the retention member.
Figure 12:
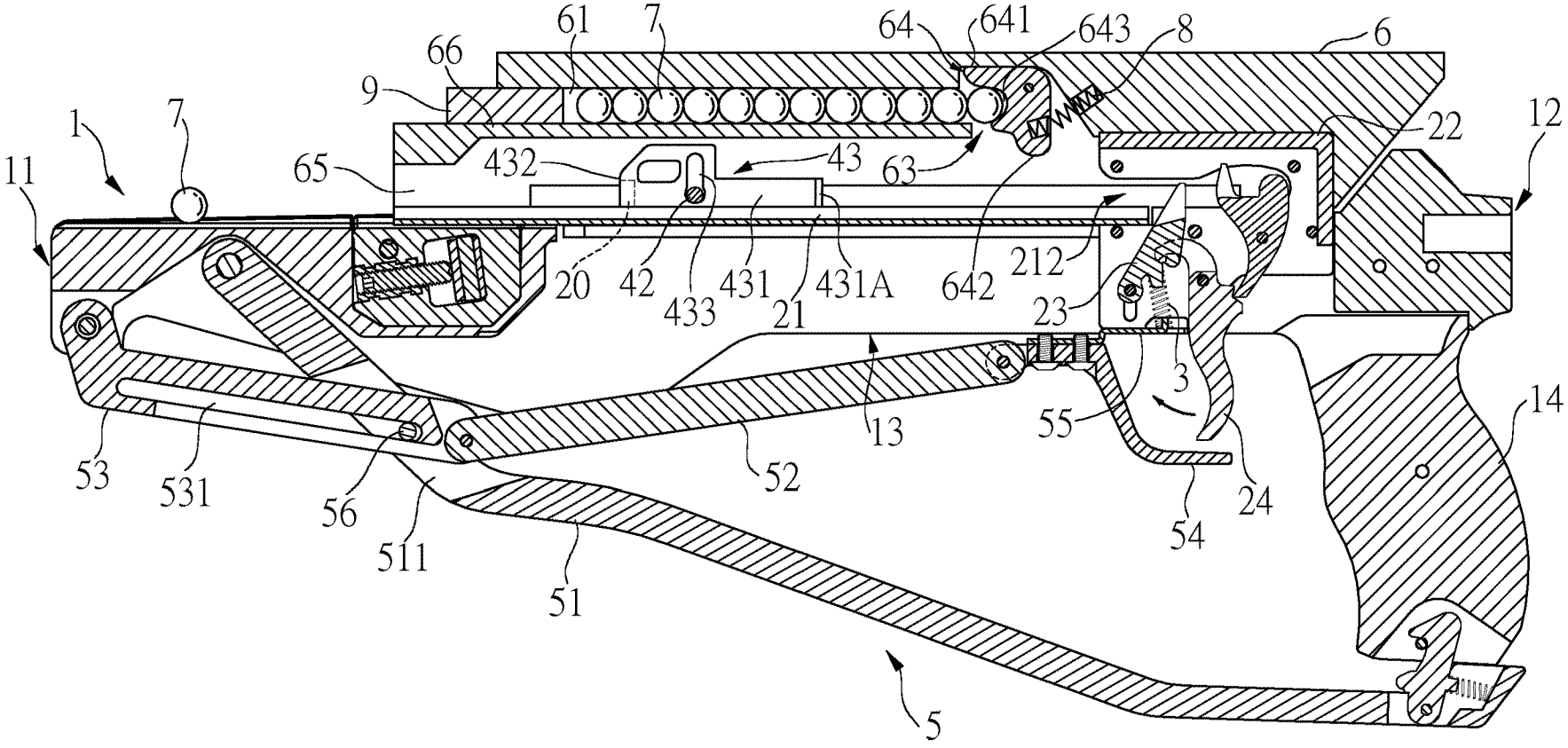
FIG. 12 shows that the retention member shoots the bullet out by the recovery force from the string.
Figure 13:
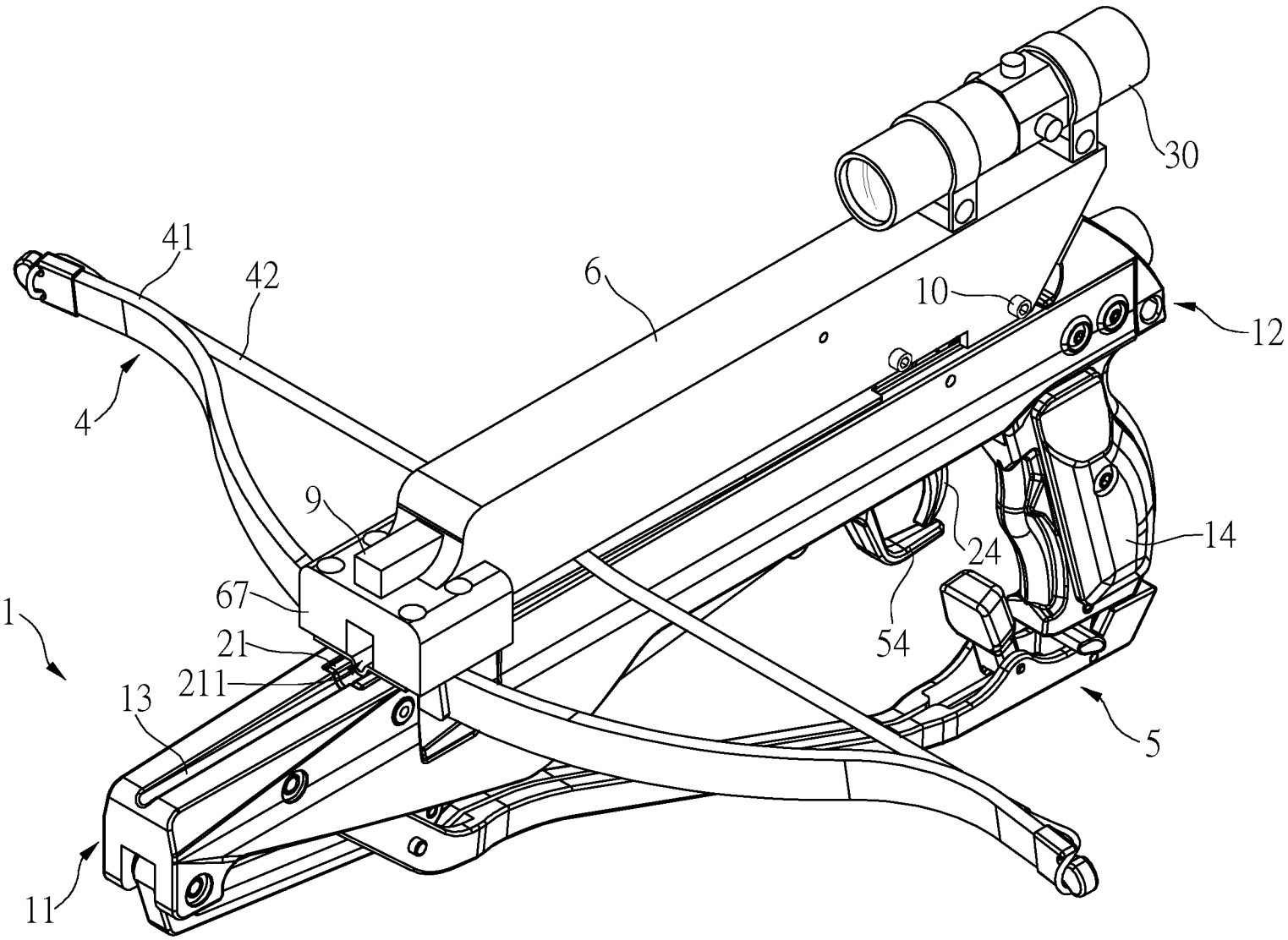
FIG. 13 shows an aim device is connected to the top of the cartridge.

In order to ensure that the bullet 7 drops to the groove 211 one at a time, as shown in FIGS. 8 to 10, a spring 8 is located between the restriction member 64 and the inside of the storage space 61 When the retention member 43 has not yet moved by the cocking device 2, the spring 8 biases the push end 642 of the restriction member 64 so that the recess 643 is located corresponding to the bullet 7 and the first bullet 7 drops to the recess 643. When the retention member 43 is moved by the cocking device 2, retention member 43 pushes the push end 642 of the restriction member 64 and pivots the restriction member 64. The recess 643 brings the bullet 7 to drop to the groove 311 from the outlet 63. The contact end 641 of the restriction member 64 stops the bullets 7 in the cartridge 6 to prevent more bullets 7 to drop. The spring 8 now stores energy. When the user pulls the trigger 24, the retention member 43 shoots the bullet 7 by the recovery force of the string 42. The restriction member 64 returns because the spring 8 is released so that the next bullet 7 enters into the recess 643. The user can operate the link device 5 to proceed the shooting action and does not need to feed another bullet 7. In order to ensure the bullets 7 to be located in the storage space 61, there is a seal 9 located at the entrance 62 of the storage space 61. The seal 9 is inserted into the storage space 61 via the entrance 62 to close the entrance 62 to prevent the bullets 7 from dropping from the entrance 62.

Figure 2:
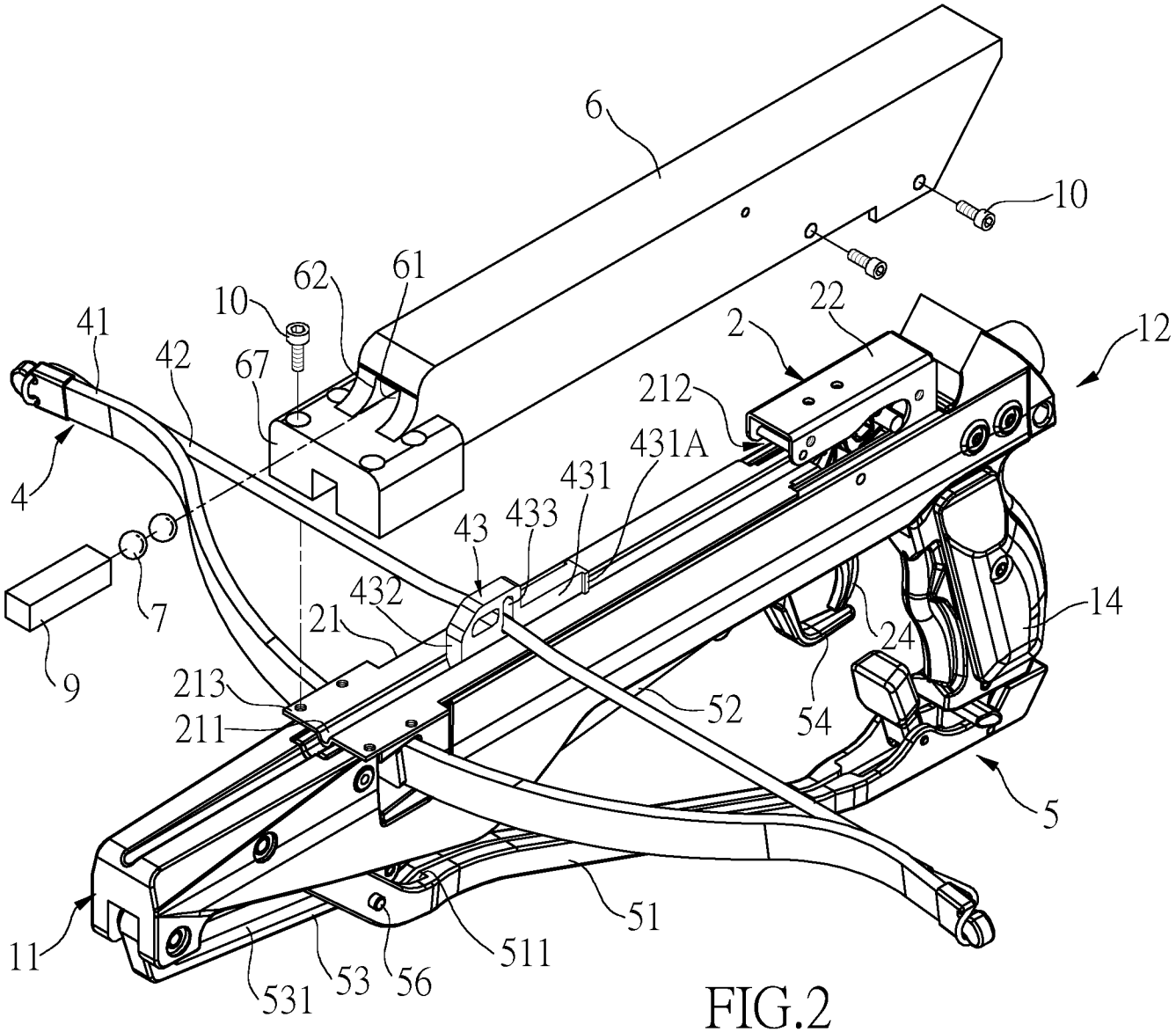
FIG. 2 is an exploded view of the crossbow of the present invention.
Figure 2A:
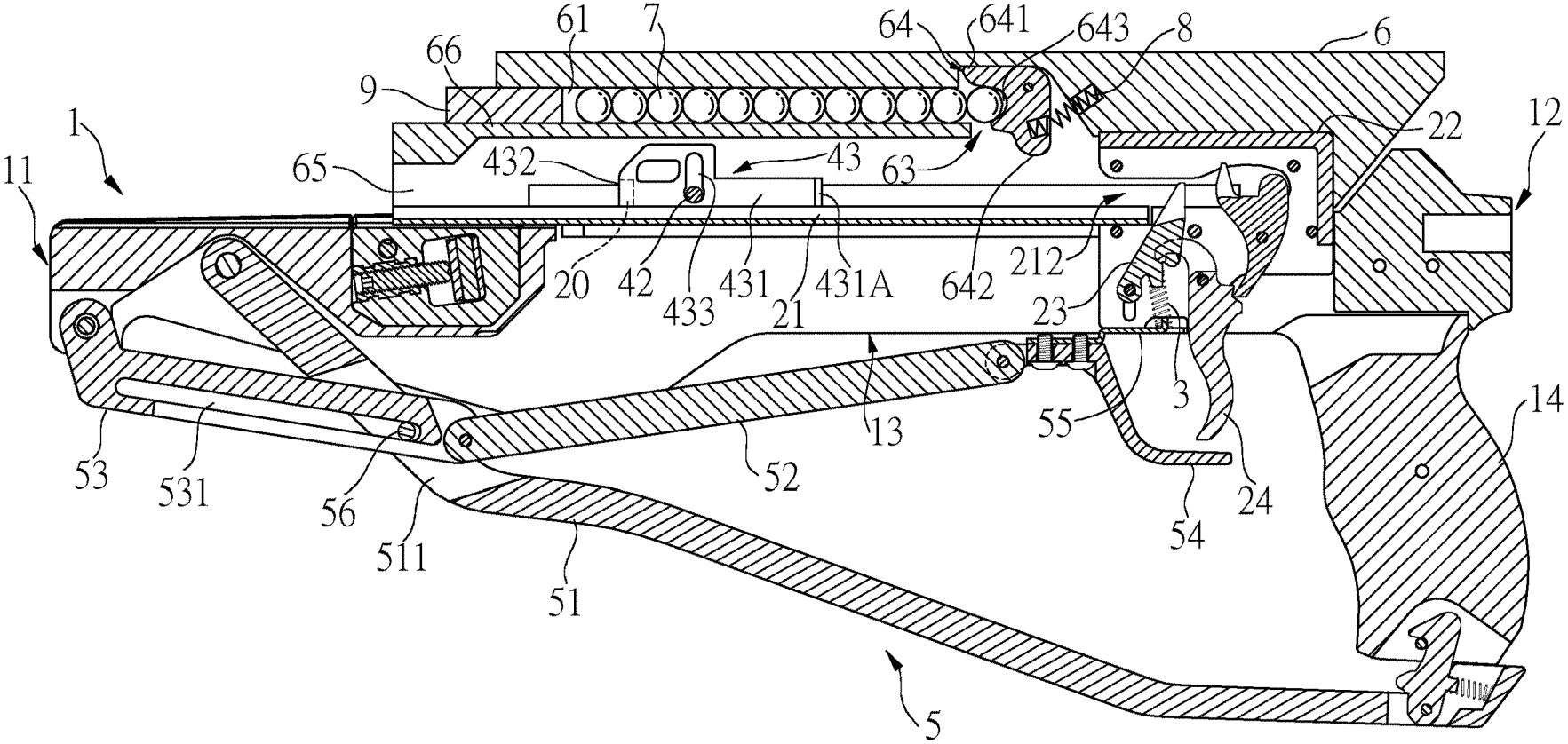
FIG. 2A is a cross sectional view, taken along line IIA-IIA in FIG. 1.
Figure 3:
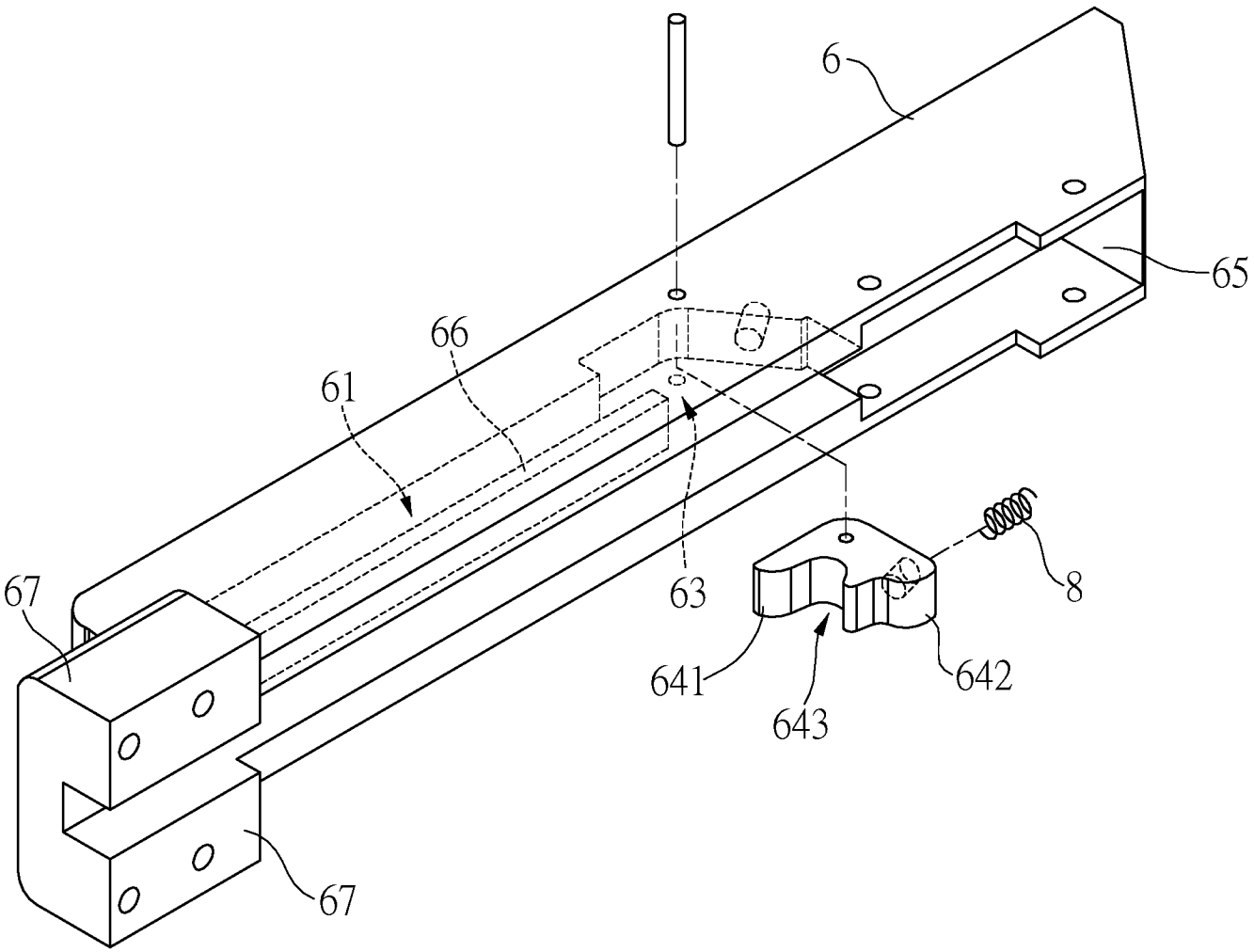
FIG. 3 shows the cartridge of the crossbow of the present invention.
Figure 4:
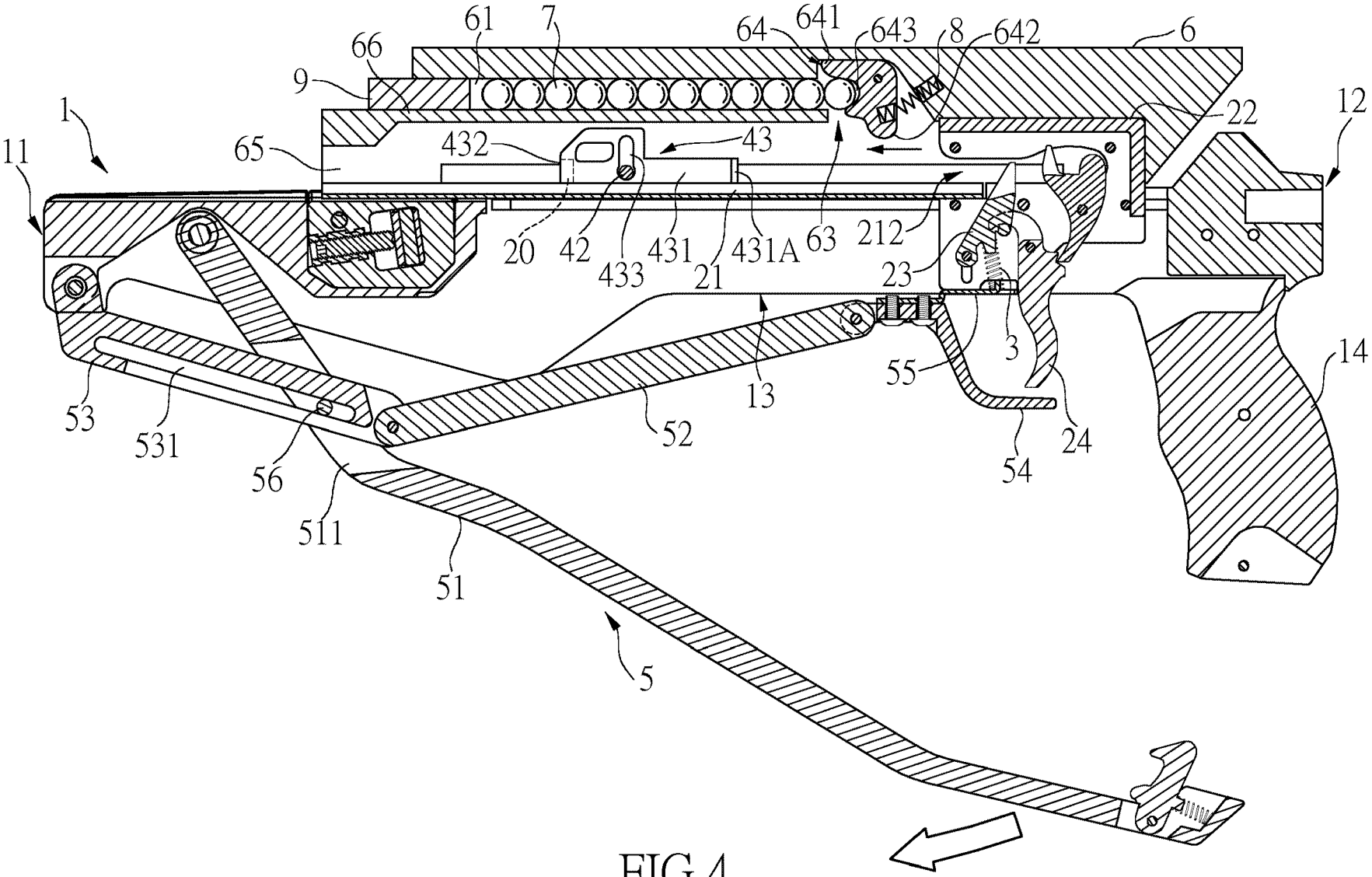
FIG. 4 shows that the pivot bar is pivoted, the frame moves, and the positioning member moves toward the retention member.

The cartridge 6 includes a passage 65 defined in the underside thereof. The passage 65 is parallel to the storage space 61, and a separation plate 66 is located between the passage 65 and the storage space 61. The retention member 43 is accommodated in the passage 65 when the cartridge 6 is connected the barrel 1. The passage 65 extends along a common direction with the storage space 61. The passage 65 communicates with the outlet 63. The second end of the frame 22 is inserted into the passage 65. Therefore, the bullets 7 are ensured that when they drop from the outlet 63 can precisely drop in the groove 211. Besides, the retention member 43 and the frame 22 are accommodated in the passage 65 and protected by the cartridge 6. The retention member 43 and the frame 22 are also ensured to be slid stably in the passage 65. As shown in FIGS. 2A, 3 and 4, the cartridge 6 includes a block 67 connected to the front end thereof, and the block 67 includes two protrusions extending from an underside thereof, and the slide 21 includes two extension plates 213 on two side thereof. The two extension plates 213 are located corresponding to the two protrusions of the block 67. The block 67 is connected to the two extension plates 213 by bolts 10, and the rear end of the cartridge 6 is fixed to the frame 22 by another bolts 10. Therefore, the cartridge 6 is firmly connected to the barrel 1 and is helpful to proceed the feature of continuously shooting as shown in FIG. 2.

Figure 5:
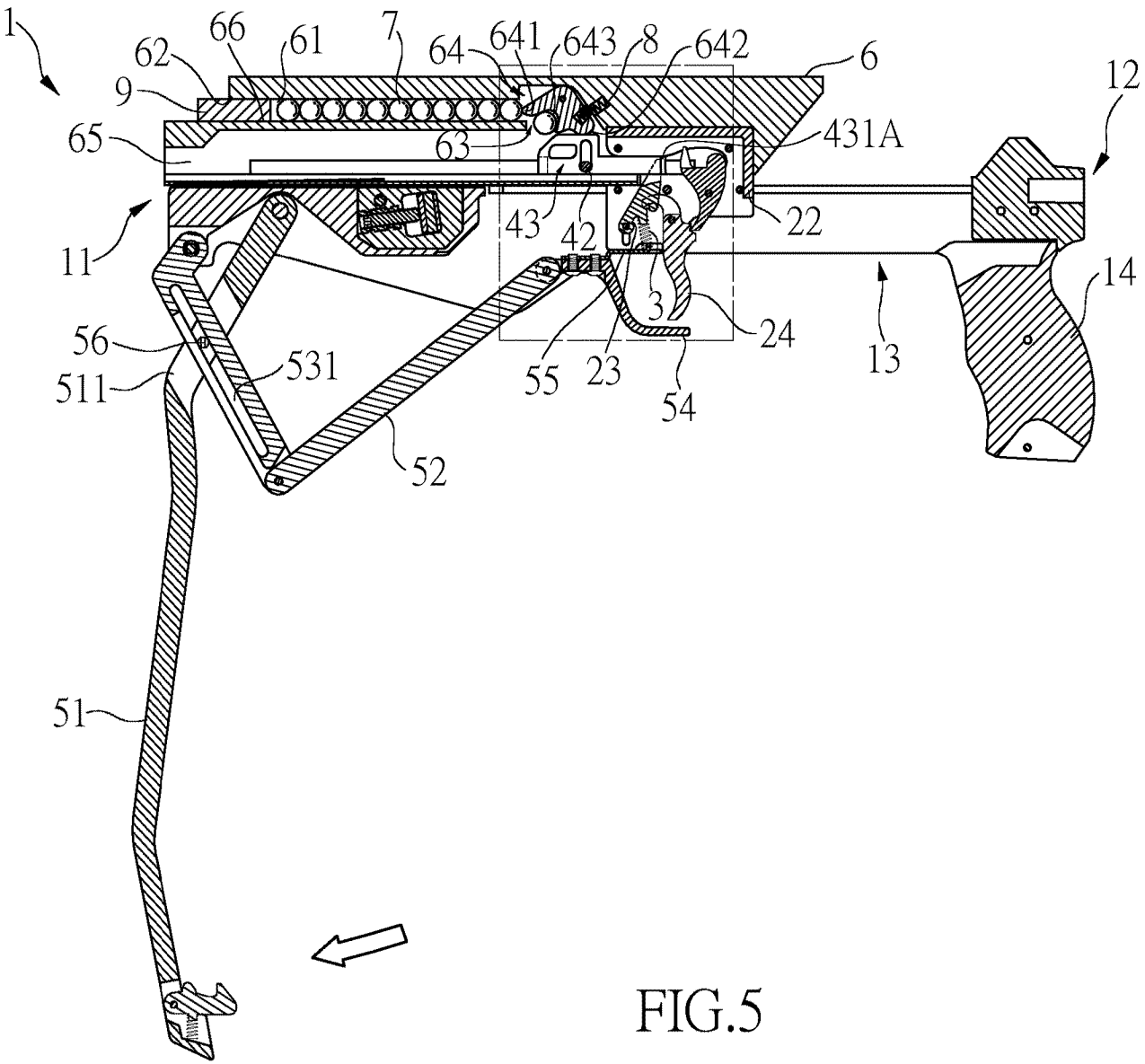
FIG. 5 shows that the positioning member moves toward and is engaged with the retention member.
Figure 6:
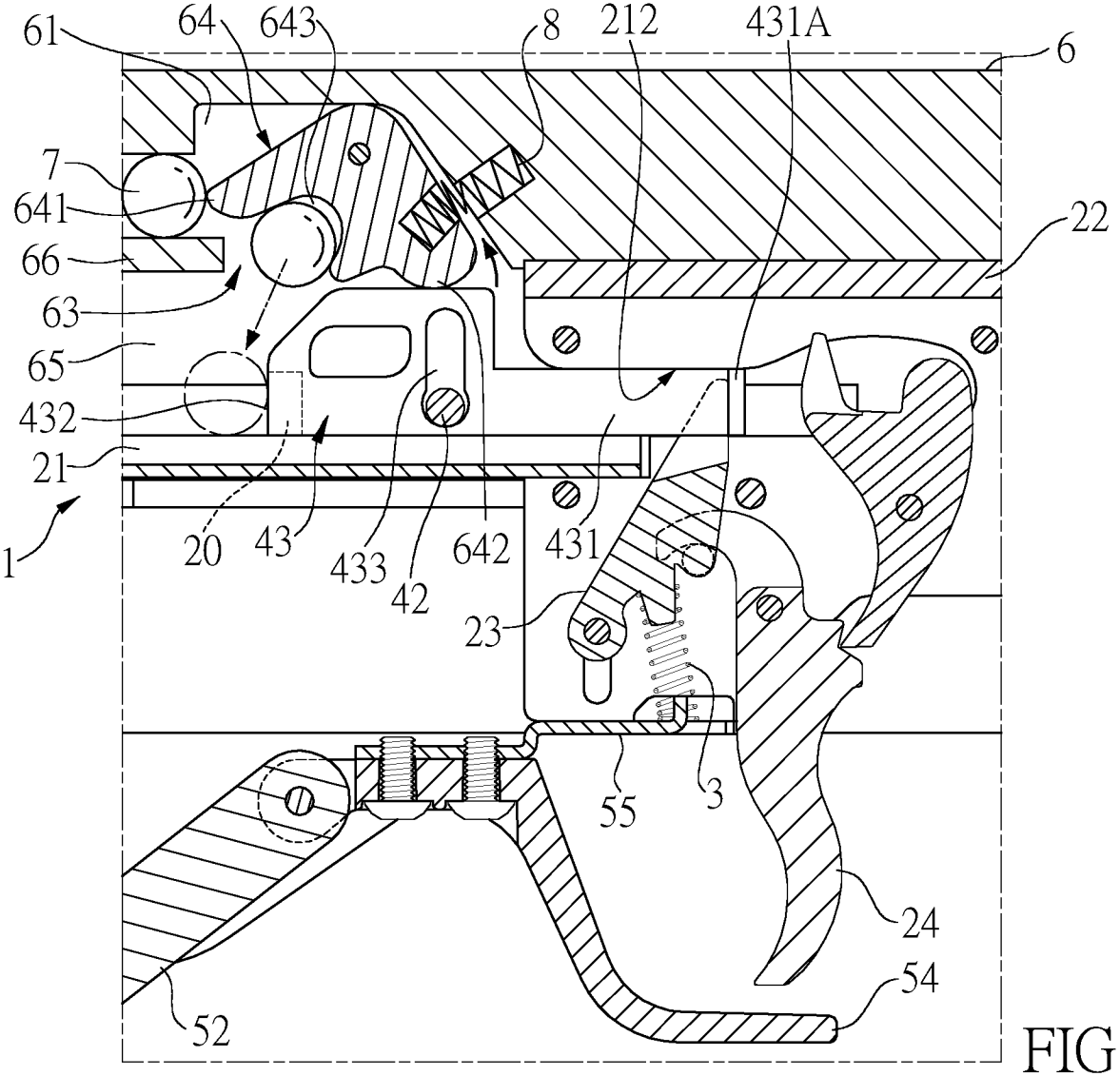
FIG. 6 is an enlarged view of the area enclosed by dotted lines in FIG. 5.
Figure 7:
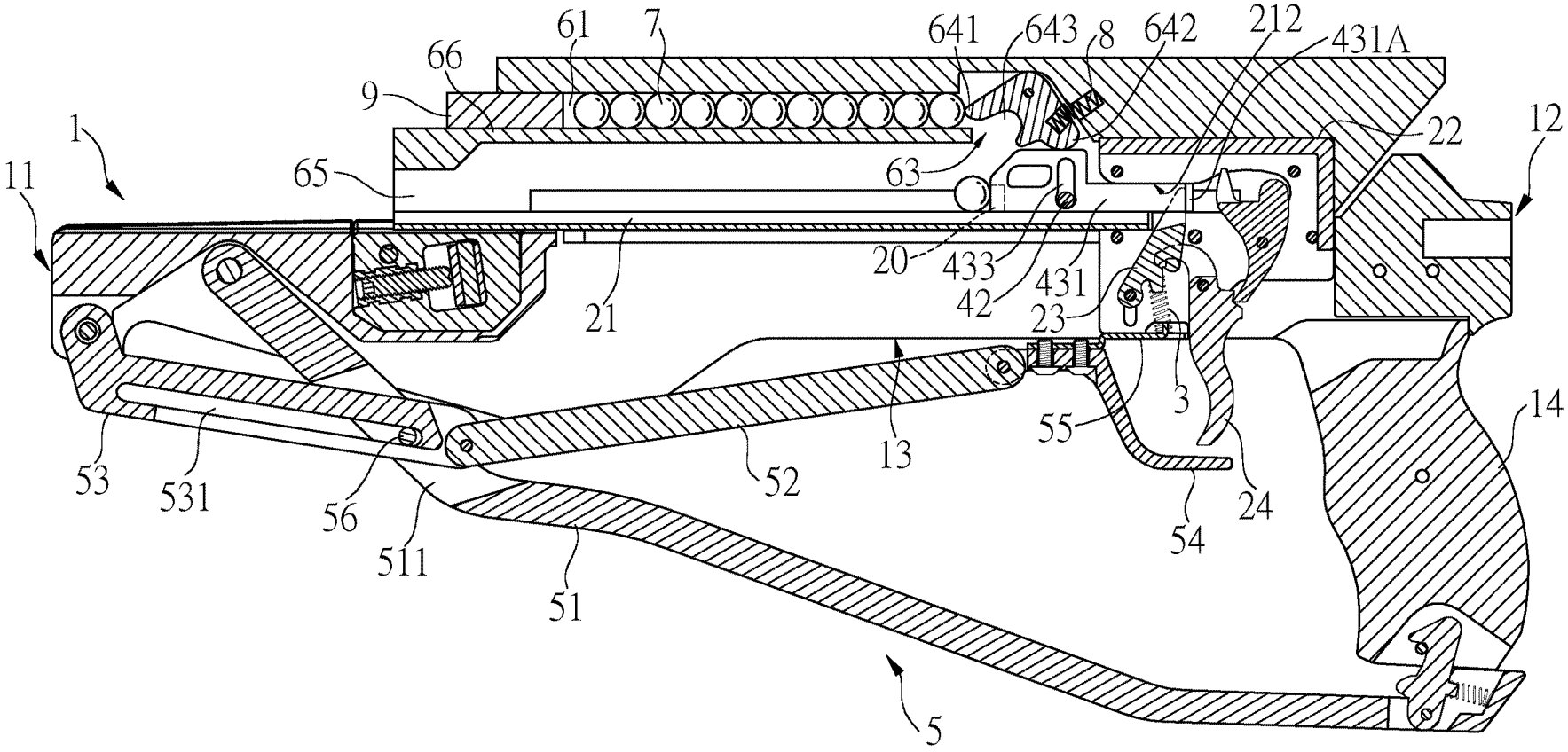
FIG. 7 shows that the pivot bar returns, the retention member pushes and pivots the restriction member, and the bullets drop in front of the retention member.

The retention member 43 includes a front head 432 and an elongate hole 433, and the elongate hole 433 is located between the front head 432 and the engaging portion 431. The front head 432 includes a magnet 20 received therein. The string 42 extends through the elongate hoe 433. The engaging portion 431 includes two ridges 431A which respectively extend laterally from the engaging portion 431 and are located opposite to the string 42. The bullets drop from the outlet 63 and are attracted on the front head 432 by the magnet 20. The cocking device 2 moves toward the retention member 43, and the positioning member 23 is located in a recessed area between the retention member 43 and restricted by the two ridges 431A. Therefore, the positioning member 23 that protruded beyond the barrel is engaged with the engaging portion 431 as shown in FIGS. 4 and 5. When the bullet 7 drops to the groove 211, the bullet 7 is attracted by the magnet 20. The magnet 20 is designed to attract the bullets 7 made of metal, if the bullets 7 are not made by metal, the magnet 20 does not attract the bullets 7. It is noted that the attraction force between the bullets 7 and the magnet 20 is smaller than the recovery force of the string 42, so that the bullet 7 will be separated from the retention member 43 and pushed by the string 42 as shown in FIGS. 8 to 10.

The link device 5 includes a pivot bar 51, a first link 52, a second link 53 and a trigger guard 54. The trigger guard 54 has the first end thereof connected to a first end of a board 55, and the second end of the board 55 is connected to an underside of the frame 22. The second end of the trigger guard 54 bends toward the trigger 24 and stops at a distance so as to protect the user's finger. The first link 52 is pivotably connected between the first end of the trigger guard 54 and the first end of the second link 53. The second end of the second link 53 is pivotably connected to the underside of the front end 11 of the barrel 1. The pivot bar 51 has the first end thereof inserted into the track 13 at the underside of the front end 11 of the barrel 1, and the second end of the pivot bar 51 is detachably connected to the lower end of the handle 14. The pivot bar 51 includes a through hole 511 through which the second link 53 extends. The second link 53 includes a slot 531 which communicates with the through hole 511. A pin 56 extends through the pivot bar 51 and the slot 531. When the pivot bar 53 is detached from the handle 14 and pivots toward the front end 11 of the barrel 1, the second link 53 is pivoted by movement of the pin 56. The first link 52 is driven by the second link 53 to control the trigger guard 54 to slide in the track 13. The trigger guard 54 drives the frame 22 to move toward the front end 11 of the barrel 1 to engage the positioning member 23 with the engaging portion 431 of the retention member 43.

The present invention provides a cartridge 6 to receive multiple bullets 7 therein which can be fed into the cartridge 6 in one time of feeding. By repeatedly operating the link device 5 and pulling the trigger 24, the cocking device 2 is moved back and forth repeatedly between the front end 11 and the rear end 12, and the retention member 43 moves back and forth to control the restriction member 64 to pivot so that the bullets 7 continuously drop to the groove 211 and are located in front of the retention member 43. When the cocking device 2 is disengaged from the engaging portion 431, the retention member 43 is pushed by the recovery force of the string 42 and deliveries the bullet 7 out. Therefore, the crossbow can shoot the bullets 7 continuously. Preferably, the cartridge 6 includes an aim device 30 on the top thereof.

While we have shown and described the embodiment in accordance with the present invention, it should be clear to those skilled in the art that further embodiments may be made without departing from the scope of the present invention.

What is claimed is:

1. A crossbow comprising:

a barrel having a front end and a rear end, a track defined in a top of the barrel and opening through the front end of the barrel, a handle connected to an underside of the rear end of the barrel;

a cocking device connected to the barrel and located above the handle, the cocking device including a slide which is installed to the track and having a groove, the cocking device including a frame, a positioning member and a trigger, the frame having a first end thereof connected to the track and located close to the handle, a second end of the frame protruding beyond the track, a room defined between frame and the top of the barrel, the frame connected to the slide and movable in the track, the positioning member having one end thereof inserted into the frame and pivotably connected with an inside of the frame, a resilient member located between the frame and the positioning member, one end of the resilient member mounted to an underside of the positioning member, another end of the resilient member fixed to the inside of the frame, the resilient member driving the positioning member to pivot and to return, the trigger having one end thereof inserted into the track from an underside of the barrel and pivotably connected to the frame and contacting the positioning member, another end of the trigger extending beyond the barrel, the trigger pivoted and driving the positioning member to pivot, and the trigger returning by the resilient member;

a bow device connected to the barrel and including a bow, a string and a retention member, the bow connected to the barrel, the retention member slidably engaged with the groove and including an engaging portion, the string extending through the retention member and connected between two ends of the bow, when the engaging portion moves away from the bow, the engaging portion is engaged with the cocking device to pull the string;

a cartridge connected to the top of the barrel and fixed to the slide, the cartridge including a storage space which includes an entrance and an outlet respectively defined in two ends thereof, a restriction member located in the storage space and located close to the outlet, the restriction member including a contact end, a push end and a recess, the recess located between the contact end and the push end, the recess communicates with the outlet, when the retention member moves toward the rear end of the barrel, the retention member pushes the push end of the restriction member and the restriction member is pivoted, the contact end contacts a bullet in the storage space, and the bullet drops to the groove and located in front of the retention member, when the cocking device is pivoted and disengaged from the engaging portion;

wherein the retention member is repeatedly moved to pivot the restriction member by engaging the string with or by disengaging the string from the cocking device, the bullets continuously drop into the groove of the slide and are located in front of the retention member, the bullets are shot by the retention member, wherein the cartridge are fed with multiple bullets with one time of feeding.

2. The crossbow as claimed in claim 1, wherein a spring is located between the restriction member and the storage space, the spring is biased between the push end of the restriction member and an inside of the storage space, the spring pushes the restriction member to be pivotably returned, the bullets drops into the recess and then drops to the outlet when the restriction member pivots.

3. The crossbow as claimed in claim 2, wherein a seal is located at the entrance of the storage space.

4. The crossbow as claimed in claim 3, wherein the cartridge includes a passage defined in an underside thereof, the retention member is accommodated in the passage which extends along a common direction with the storage space, the passage communicates with the outlet, the second end of the frame is inserted into the passage.

5. The crossbow as claimed in claim 4, wherein the retention member includes a front head and an elongate hole, the elongate hole is located between the front head and the engaging portion, the front head includes a magnet received therein, the string extends through the elongate hoe, the engaging portion includes two ridges which respectively extend laterally from the engaging portion and located opposite to the string, the bullets drop from the outlet and are attracted on the front head by the magnet, the cocking device moves toward the retention member and the positioning member is engaged with the engaging portion and restricted by the two ridges.

6. The crossbow as claimed in claim 5, wherein an attraction force between the bullets and the magnet is smaller than a recovery force of the string.

7. The crossbow as claimed in claim 6, wherein the cartridge includes a block connected to a front end thereof, the block includes two protrusions extending from an underside thereof, the slide includes two extension plates on two side thereof and the two extension plates are located corresponding to the two protrusions of the block, the block is connected to the two extension plates by bolts, a rear end of the cartridge is fixed to the frame by another bolts.

8. The crossbow as claimed in claim 7, wherein the barrel includes a link device connected to the underside thereof, a front end of the link device is pivotably connected to the underside of the front end of the barrel, a rear end of the link device is fixed to the slide and removably engaged with a lower end of the handle, the link device includes a pivot bar, a first link, a second link and a trigger guard, the trigger guard has a first end thereof connected to a first end of a board, a second end of the board is connected to an underside of the frame, a second end of the trigger guard bends toward the trigger and stops at a distance, the first link is pivotably connected between the first end of the trigger guard and a first end of the second link, a second end of the second link is pivotably connected to the underside of the front end of the barrel, the pivot bar has a first end thereof inserted into the track at the underside of the front end of the barrel, a second end of the pivot bar is detachably connected to the lower end of the handle, the pivot bar includes a through hole through which the second link extends, the second link includes a slot which communicates with the through hole, a pin extends through the pivot bar and the slot, the pivot bar is detached from the handle and pivots toward the front end of the barrel, and the second link is pivoted by movement of the pin, the first link is driven by the second link to control the trigger guard to slide in the track, the trigger guard drives the frame to move toward the front end of the barrel to engage the positioning member with the engaging portion of the retention member.

9. The crossbow as claimed in claim 8, wherein the cartridge includes an aim device on a top thereof.

* * * * *